US007267172B2

(12) United States Patent
Hofman

(10) Patent No.: US 7,267,172 B2
(45) Date of Patent: Sep. 11, 2007

(54) CEMENTED OPEN HOLE SELECTIVE FRACING SYSTEM

(75) Inventor: Raymond A. Hofman, Midland, TX (US)

(73) Assignee: Peak Completion Technologies, Inc., Midland, TX (US)

( * ) Notice: Subject to any disclaimer, the term of this patent is extended or adjusted under 35 U.S.C. 154(b) by 305 days.

(21) Appl. No.: 11/079,950

(22) Filed: Mar. 15, 2005

(65) Prior Publication Data

US 2006/0207763 A1 Sep. 21, 2006

(51) Int. Cl.
*E21B 43/26* (2006.01)

(52) U.S. Cl. ..... 166/281; 166/308.1; 166/373

(58) Field of Classification Search ..... 166/308.1, 166/373, 281

See application file for complete search history.

(56) References Cited

U.S. PATENT DOCUMENTS 4,516,879 A * 5/1985 Berry et al. ..... 405/132
4,949,788 A * 8/1990 Szarka et al. ..... 166/285
5,894,888 A 4/1999 Wiemers et al.
6,047,773 A * 4/2000 Zeltmann et al. ..... 166/281
6,446,727 B1 9/2002 Zemlak et al.
6,460,619 B1 10/2002 Braithwaite et al.
6,763,885 B2 * 7/2004 Cavender ..... 166/278
6,907,936 B2 6/2005 Fehr et al.
7,021,384 B2 4/2006 Themig et al.
7,096,954 B2 8/2006 Weng et al.
7,108,060 B2 9/2006 Jones
7,108,067 B2 9/2006 Themig et al.

OTHER PUBLICATIONS www.packersplus.com Packers Plus Energy Services.
www.halliburton.com Technology * Expertise * Quality * Halliburton.
www.snydertex.com/mesquite/guiberson/htm Mesquite Oil Tools, Inc.: "Guiberson Retrievable Packers Systems, Uni-Packer V".

* cited by examiner

*Primary Examiner*—William Neuder
*Assistant Examiner*—Nicole Coy
(74) *Attorney, Agent, or Firm*—Gunn & Lee, P.C.

(57) ABSTRACT

A cemented open hole selective fracing system is shown. In the producing zone, an open hole is drilled therein and a production tubing is cemented in place. At preselected locations along the production tubing, the production tubing will have sliding valves located there along. The sliding valves may be selectively opened by a shifting tool, and the cement around the sliding valve dissolved. Thereafter, the formation may be fraced immediately adjacent the opened sliding valve. By selectively opening different combinations of sliding valves, fracing can occur in stages with more fracing pressure and more fracing fluid being delivered deeper into the formation. Just as the sliding valves can be selectively opened with a switching tool, the sliding valves can also be selectively closed to protect the production of the well.

11 Claims, 8 Drawing Sheets

CEMENTED OPEN HOLE SELECTIVE FRACING SYSTEM

FIELD OF THE INVENTION

This invention relates to a system for fracing producing formations for the production of oil or gas and, more particularly, for fracing in a cemented open hole using sliding valves, which sliding valves may be selectively opened or closed according to the preference of the producer.

BACKGROUND OF THE INVENTION

Fracing is a method to stimulate a subterranean formation to increase the production of fluids, such as oil or natural gas. In hydraulic fracing, a fracing fluid is injected through a well bore into the formation at a pressure and flow rate at least sufficient to overcome the pressure of the reservoir and extend fractures into the formation. The fracing fluid may be of any of a number of different media, including: sand and water, bauxite, foam, liquid $CO^2$, nitrogen, etc. The fracing fluid keeps the formation from closing back upon itself when the pressure is released. The objective is for the fracing fluid to provide channels through which the formation fluids, such as oil and gas, can flow into the well bore and be produced.

One of the prior problems with earlier fracing methods is they require cementing of a casing in place and then perforating the casing at the producing zones. This in turn requires packers between various stages of the producing zone. An example of prior art that shows perforating the casing to gain access to the producing zone is shown in Zemiak (U.S. Pat. No. 6,446,727), assigned to Schlumberger Technology Corporation. The perforating of the casing requires setting off an explosive charge in the producing zone. The explosion used to perforate the casing can many times cause damage to the formation. Plus, once the casing is perforated, then it becomes hard to isolate that particular zone and normally requires the use of packers both above and below the zone.

Another example of producing in the open hole by perforating the casing is shown in Wiemers (U.S. Pat. No. 5,894,888). One of the problems with Wiemers is the fracing fluid is delivered over the entire production zone and you will not get concentrated pressures in preselected areas of the formation. Once the pipe is perforated, it is very hard to restore and selectively produce certain portions of the zone and not produce other portions of the zone.

When fracing with sand, sand can accumulate and block flow. Jones, published patent application (US 2004/0050551 A1) shows fracing through perforated casing and the use of shunt tubes to give alternate flow paths. Jones does not provide a method for alternately producing different zones or stages of a formation.

One of the methods used in producing horizontal formations is to provide casing in the vertical hole almost to the horizontal zone being produced. At the bottom of the casing, holes extend horizontally, either one or multiple holes. Also, at the bottom of the casing, a liner hanger is set with production tubing then extending into the open hole. Packers are placed between each stage of production in the open hole, with sliding valves along the production tubing opening or closing depending upon the stage being produced. An example is shown in Weng, et al. published patent application (US 2003/0121663 A1), where packers separate different zones to be produced with nozzles (referred to as "burst disks") being placed along the production tubing to inject fracing fluid into the formations. However, there are disadvantages to this particular method. The fracing fluid will be delivered the entire length of the production tubing between packers. This means there will not be a concentrated high pressure fluid being delivered to a small area of the formation. Also, the packers are expensive to run and set inside of the open hole in the formation.

Applicant previously worked for Packers Plus Energy Services, Inc., who had a system similar to that shown in the Weng, et al. patent. By visiting the Packers Plus website of www.packersplus.com, more information can be gained about Packers Plus and their products. Examples of the technology used by Packers Plus can be found in published U.S. patent application Nos.:

| Publication No. | Title |
|---|---|
| 2004/0129422 | Apparatus and Method for Well Bore Isolation |
| 2004/0118564 | Method and Apparatus for Well Bore Fluid Treatment |
| 2003/0127227 | Method and Apparatus for Well Bore Fluid Treatment |

Each of these published patent applications shows packers being used to separate different producing zones. However, the producing zones may be along long lengths of the production tubing, rather than in a concentrated area.

The founders of Packers Plus previously worked for Guiberson, which was acquired by Dresser Industries and later by Halliburton. The techniques used by Packers Plus were previously used by Guiberson/Dresser/Halliburton. Some examples of well completion methods by Halliburton can be found on the website of www.halliburton.com, including the various techniques they utilize. Also, the sister companies of Dresser Industries and Guiberson can be visited on the website of www.dresser.com. Examples of the Guiberson retrievable packer systems can be found on the Mesquite Oil Tool Inc. website of www.snydertex.com/mesquite/guiberson/htm.

None of the prior art known by applicant, including that of his prior employer, utilized cementing production tubing in place in the production zone with sliding valves being selectively located along the production tubing. None of the prior systems show (1) the sliding valve being selectively opened or closed, (2) the cement therearound being dissolved, and/or (3) selectively fracing with predetermined sliding valves. All of the prior systems known by applicant utilize packers between the various stages to be produced and have fracing fluid injected over a substantial distance of the production tubing in the formation, not at preselected points adjacent the sliding valves.

SUMMARY OF THE INVENTION

It is an object of the present invention to provide a cemented open hole fracing system.

It is another object of the present invention to provide a cemented open hole fracing system that may be selectively operated by selecting and opening certain stages to be fraced, but not other stages.

It is still another object of the present invention to provide a system for fracing in the production zone with multiple stages of sliding valves, which sliding valves are cemented into place.

It is yet another object of the present invention to provide a cemented open hole fracing system that may be used in multi laterals with different valves being selectively operated so the production formation may be fraced in stages.

A well used to produce hydrocarbons is drilled into the production zone. Once in the production zone, either a single hole may extend there through, or there may be multiple holes in vertical or lateral configurations into the production zone connecting to a single wellhead. A casing is cemented into place below the wellhead. However, in the production zone, there will be an open hole. By use of a liner hanger at the end of the casing, production tubing is run into the open hole, which production tubing will have sliding valves located therein at preselected locations. The production tubing and sliding valves are cemented solid in the open hole. Thereafter, by running a shifting tool into the production tubing, preselected sliding valves can be opened and the cement therearound dissolved by a suitable acid or other solvent. Once the cement is dissolved, fracing may begin adjacent the preselected sliding valves. Any combination of sliding valves can be opened and dissolve the cement therearound. In this manner, more than one area can be fraced at a time. A fracing fluid is then injected through the production tubing and the preselected sliding valves into the production zone. The fracing fluid can be forced further into the formation by having a narrow annulus around the preselected sliding valves in which the fracing fluid is injected into the formation. This causes the fracing fluid to go deeper into the petroleum producing formation. By operation of the sliding valves with a shifting tool, any number or combination of the sliding valves can be opened at one time.

If it is desired to shut off a portion of the producing zone because it is producing water or is an undesirable zone, by operation of the sliding valve, that area can be shut off.

By the use of multi lateral connections, different laterals may be produced at different times or simultaneously. In each lateral, there would be a production pipe cemented into place with sliding valves at preselected locations there along. The producer would selectively connect to a particular lateral, either through a liner hanger mounted in the bottom of the casing, or through a window in the side of the casing. If a window is used in the side of the casing, it may be necessary to use a bent joint for connecting to the proper hanger. In the laterals, a packer may be used as a hanger in the open hole.

By the use of the present invention, many different laterals can be produced from a single well. The well operator will need to know the distance to the various laterals and the distance along the laterals to the various sliding valves. By knowing the distance, the operator can then (a) select the lateral and/or (b) select the particular valves to be operated for fracing.

Shifting tools located on the end of a shifting string can be used to operate the sliding valves in whatever manner the well operator desires.

DESCRIPTION OF THE PREFERRED EMBODIMENT

Figure 1:
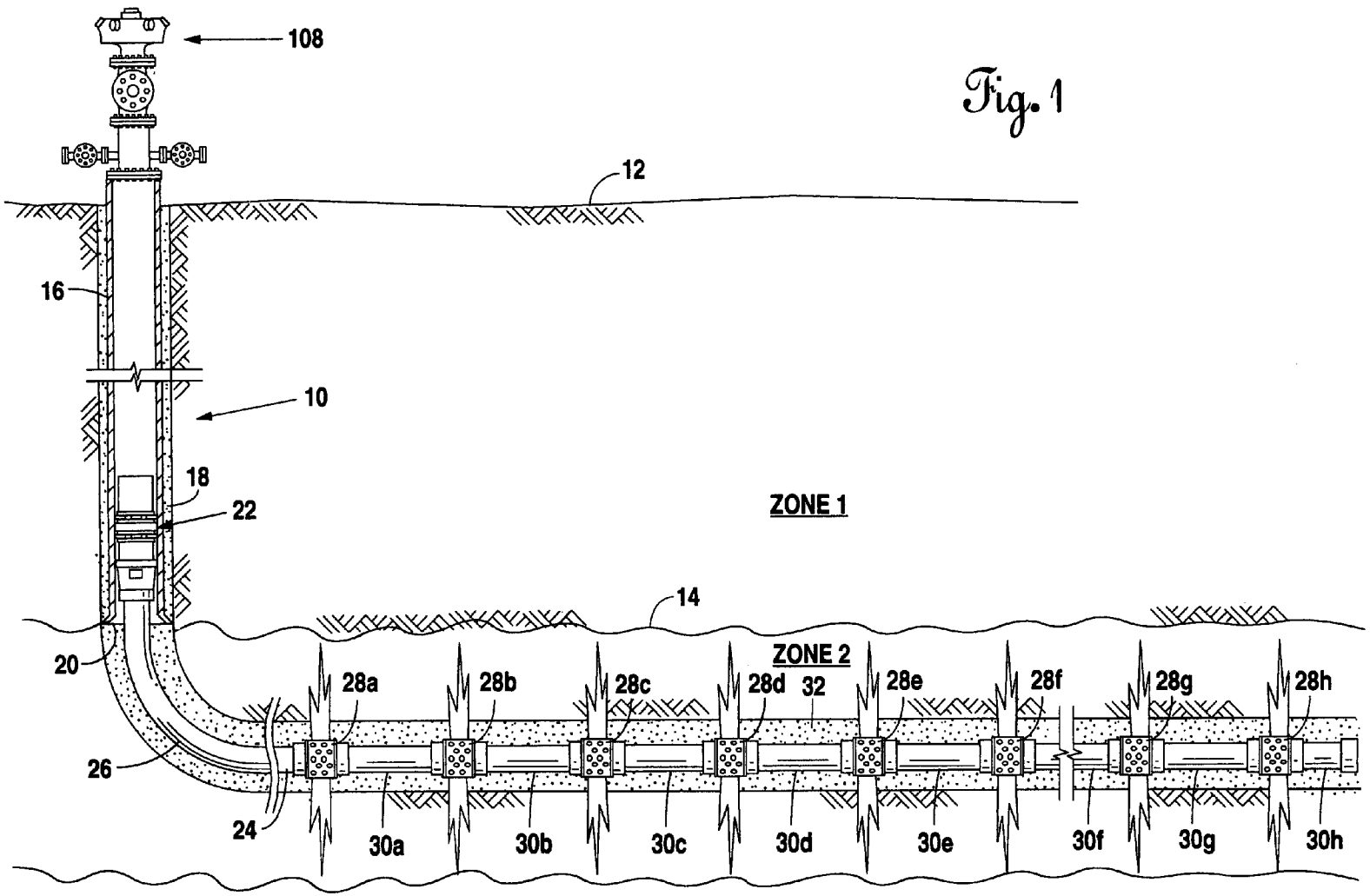
FIG. 1 is a pictorial cross-sectional view of a well with a cemented open hole fracing system in a lateral located in a producing zone.

A cemented open hole selective fracing system is pictorially illustrated in FIG. 1. A production well 10 is drilled in the earth 12 to a hydrocarbon production zone 14. A casing 16 is held in place in the production well 10 by cement 18. At the lower end 20 of production casing 16 is located liner hanger 22. Liner hanger 22 may be either hydraulically or mechanically set.

Below liner hanger 22 extends production tubing 24. To extend laterally, the production well 10 and production tubing 24 bends around a radius 26. The radius 26 may vary from well to well and may be as small as 30 feet and as large as 400 feet. The radius of the bend in production well 10 and production tubing 24 depends upon the formation and equipment used.

Inside of the hydrocarbon production zone 14, the production tubing 24 has a series of sliding valves pictorially illustrated as 28*a* thru 28*h*. The distance between sliding valves 28*a* thru 28*h* may vary according to the preference of the particular operator. A normal distance is the length of a standard production tubing of 30 feet. However, the production tubing segments 30*a* thru 30*h* may vary in length depending upon where the sliding valves 28 should be located in the formation.

The entire production tubing 24, sliding valves 28, and the production tubing segments 30 are all encased in cement 32. Cement 32 located around production tubing 24 may be different from the cement 18 located around the casing 16.

In actual operation, sliding valves 28*a* thru 28*h* may be opened or closed with a shifting tool as will be subsequently described. The sliding valves 28*a* thru 28*h* may be opened in any order or sequence.

For the purpose of illustration, assume the operator of the production well 10 desires to open sliding valve 28*h*. A shifting tool 34, such as that shown in FIG. 2, connected on shifting string would be lowered into the production well 10 through casing 16 and production tubing 24. The shifting tool 34 has two elements 34*a* and 34*b* that are identical, except they are reversed in direction and connected by a shifting string segment 38. While the shifting string segment 38 is identical to shifting string 36, shifting string segment 38 provides the distance that is necessary to separate shifting tools 34*a* and 34*b*. Typically, the shifting string segment 38 would be about 30 feet in length.

Figure 3:
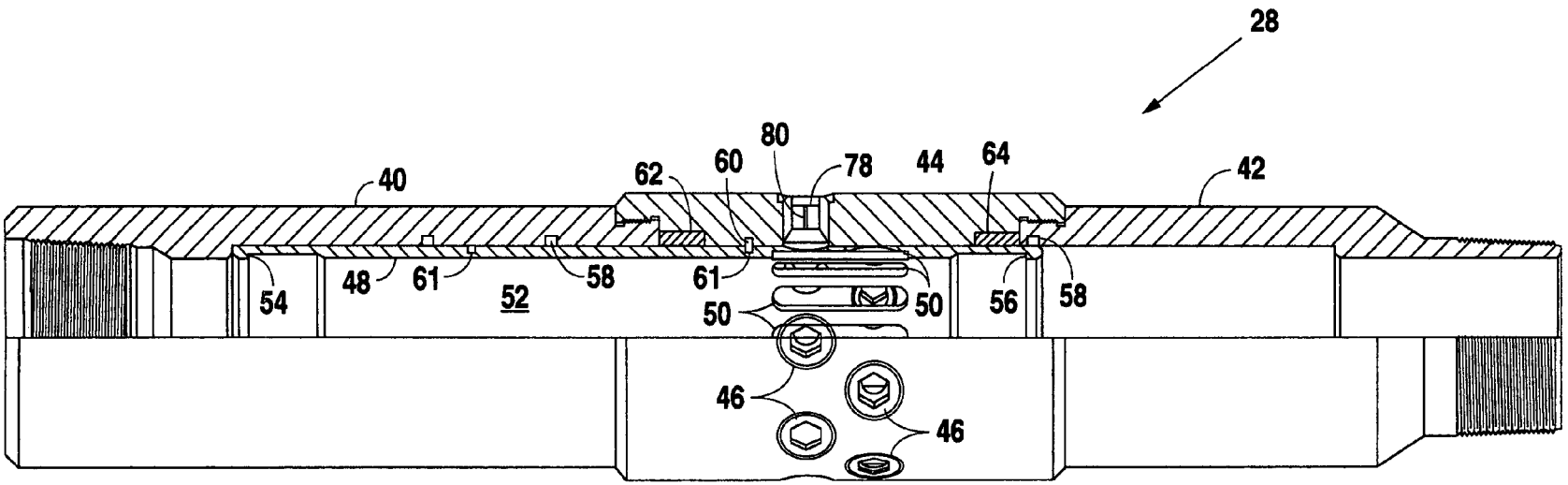
FIG. 3 is an elongated partial sectional view of a sliding valve.

To understand the operation of shifting tool 34 inside sliding valves 28, an explanation as to how the shifting tool 34 and sliding valves 28 work internally is necessary. Referring to FIG. 3, a partial cross-sectional view of the sliding valve 28 is shown. An upper housing sub 40 is connected to a lower housing sub 42 by threaded connections via the nozzle body 44. A series of nozzles 46 extend through the nozzle body 44. Inside of the upper housing sub 40, lower housing sub 42, and nozzle body 44 is an inner sleeve 48. Inside of the inner sleeve 48 are slots that allow fluid communication from the inside passage 52 through the slots 50 and nozzles 46 to the outside of the sliding valve 28. The inner sleeve 48 has an opening shoulder 54 and a closing shoulder 56 located therein.

Figure 4:
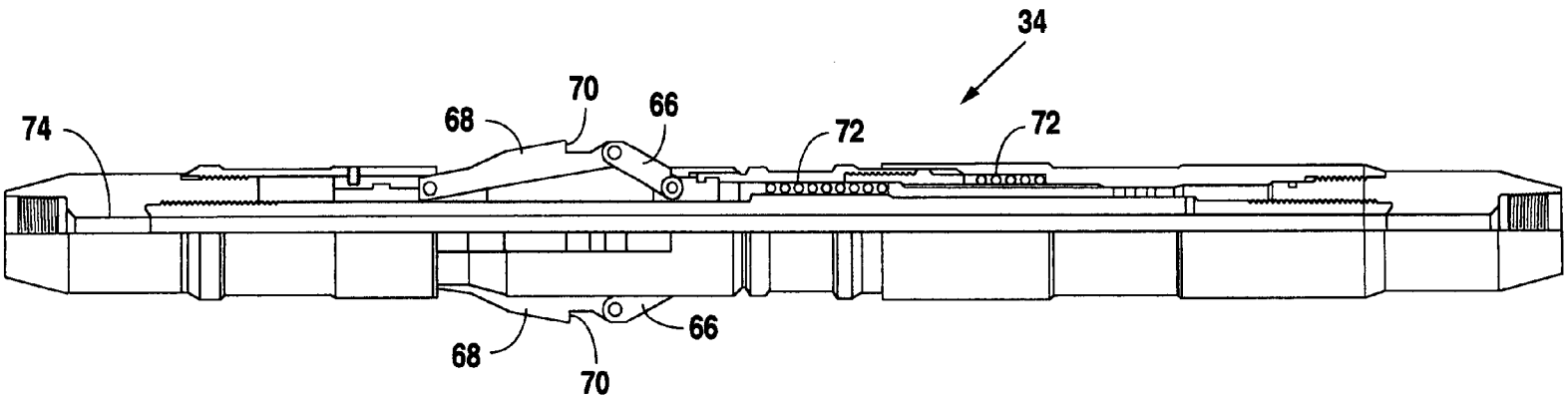
FIG. 4 is an elongated partial sectional view of a single shifting tool.

When the shifting tool 34 shown in FIG. 4 goes into the sliding valve 28, shifting tool 34*a* performs the closing function and shifting tool 34*b* performs the opening function. Shifting tools 34*a* and 34*b* are identical, except reverse and connected through the shifting string segment 38.

Figure 5A:
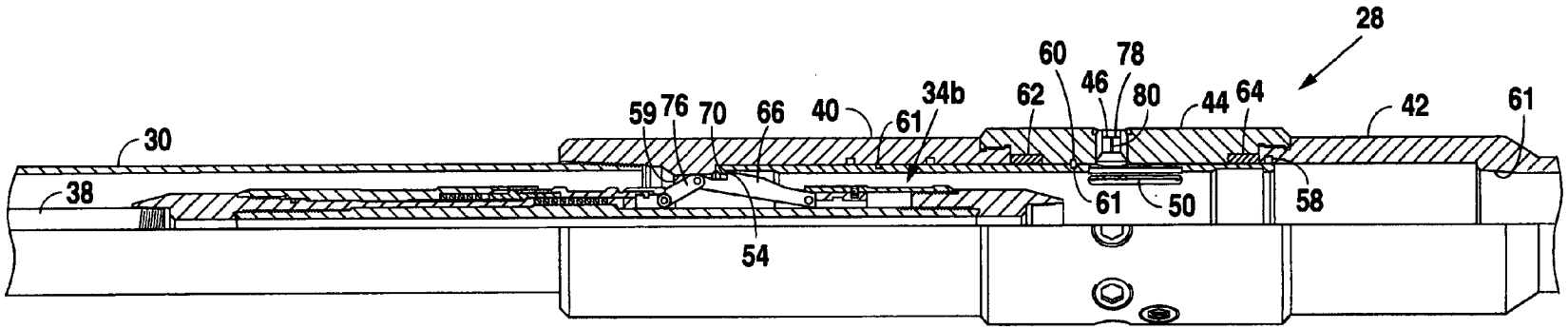
FIG. 5A is an elongated partial sectional view illustrating a shifting tool opening the sliding valve.

Assume the shifting tool 34 is lowered into production well 10 through the casing 16 and into the production tubing 24. Thereafter, the shifting tool 34 will go around the radius 26 through the shifting valves 28 and production pipe segments 30. Once the shifting tool 34*b* extends beyond the last sliding valve 28*h*, the shifting tool 34*b* may be pulled back in the opposite direction as illustrated in FIG. 5A to open the sliding valve 28, as will be explained in more detail subsequently.

Referring to FIG. 3, the sliding valve 28 has wiper seals 58 between the inner sleeve 48 and the upper housing sub 42 and the lower housing sub 44. The wiper seals 58 keep debris from getting back behind the inner sleeve 48, which could interfere with its operation. This is particularly important when sand is part of the fracing fluid.

Also located between the inner sleeve 48 and nozzle body 44 is a C-clamp 60 that fits in a notch undercut in the nozzle body 44 and into a C-clamp notch 61 in the outer surface of inner sleeve 48. The C-clamp puts pressure in the notches and prevents the inner sleeve 48 from being accidentally moved from the opened to closed position or vice versa, as the shifting tool is moving there through.

Also, seal stacks 62 and 64 are compressed between (1) the upper housing sub 40 and nozzle body 44 and (2) lower housing sub 42 and nozzle body 44, respectively. The seal stacks 62 and 64 are compressed in place and prevent leakage from the inner passage 52 to the area outside sliding valve 28 when the sliding valve is closed.

Turning now to the shifting tool 34, an enlarged partial cross-sectional view is shown in FIG. 4. Selective keys 66 extend outward from the shifting tool 34. Typically, a plurality of selective keys 66, such as four, would be contained in any shifting tool 34, though the number of selective keys 66 may vary. The selective keys 66 are spring loaded so they normally will extend outward from the shifting tool 34 as is illustrated in FIG. 4. The selective keys 66 have a beveled slope 68 on one side to push the selective keys 66 in, if moving in a first direction to engage the beveled slope 68, and a notch 70 to engage any shoulders, if moving in the opposite direction. Also, because the selective keys 66 are moved outward by spring 72, by applying proper pressure inside passage 74, the force of spring 72 can be overcome and the selective keys 66 may be retracted by fluid pressure applied from the surface.

Referring now to FIG. 5A, assume the opening shifting tool 34*b* has been lowered through sliding valve 28 and thereafter the direction reversed. Upon reversing the direction of the shifting tool 34*b*, the notch 70 in the shifting tool will engage the opening shoulder 54 of the inner sleeve 48 of sliding valve 28. This will cause the inner sleeve 48 to move from a closed position to an opened position as is illustrated in FIG. 5A. This allows fluid in the inside passage 58 to flow through slots 50 and nozzles 46 into the formation around sliding valve 28. As the inner sleeve 48 moves into the position as shown in FIG. 5A, C-clamp 60 will hold the inner sleeve 48 in position to prevent accidental shifting by engaging one of two C-clamp notches 61. Also, as the inner sleeve 48 reaches its open position and C-clamp 60 engages, simultaneously the inner diameter 59 of the upper housing sub 40 presses against the slope 76 of the selective key 66, thereby causing the selective keys 66 to move inward and notch 70 to disengage from the opening shoulder 54.

Figure 5B:
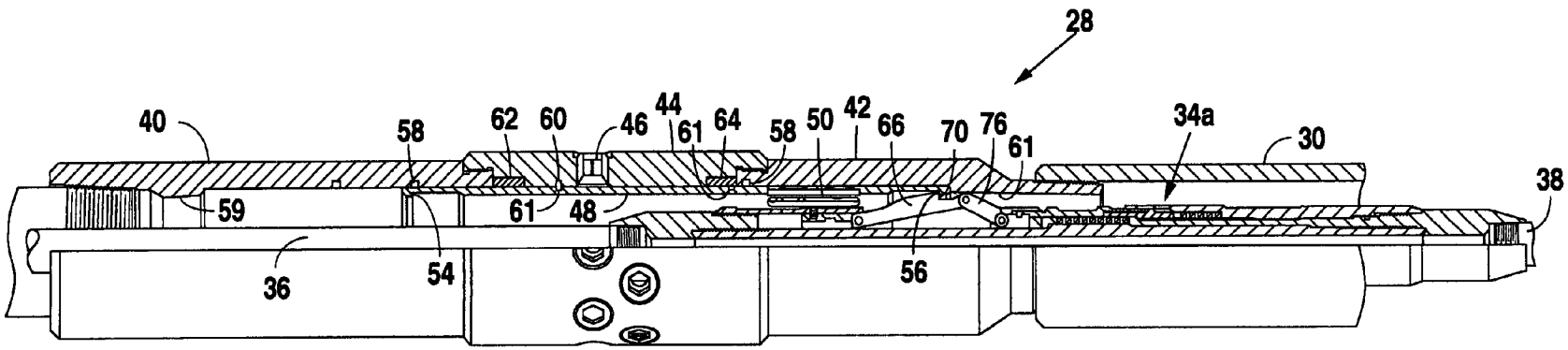
FIG. 5B is an elongated partial sectional view illustrating a shifting tool closing the sliding valve.

If it is desired to close a sliding valve 28, the same type of shifting tool will be used, but in the reverse direction, as illustrated in FIG. 5B. The shifting tool 34*a* is arranged in the opposite direction so that now the notch 70 in the selective keys 66 will engage closing shoulder 56 of the inner sleeve 48. Therefore, as the shifting tool 34*a* is lowered through the sliding valve 28, as shown in FIG. 5B, the inner sleeve 48 is moved to its lowermost position and flow between the slots 50 and nozzles 46 is terminated. The seal stacks 62 and 64 insure there is no leakage. Wiper seals 58 keep the crud from getting behind the inner sleeve 48.

Also, as the shifting tool 34A moves the inner sleeve 48 to its lowermost position, pressure is exerted on the slope 76 by the inner diameter 61 of lower housing sub 42 of the selective keys 66 to disengage the notch 70 from the closing shoulder 56. Simultaneously, the C-clamp 60 engages in another C-clamp notch 61 in the outer surface of the inner sleeve 48.

Figure 2:
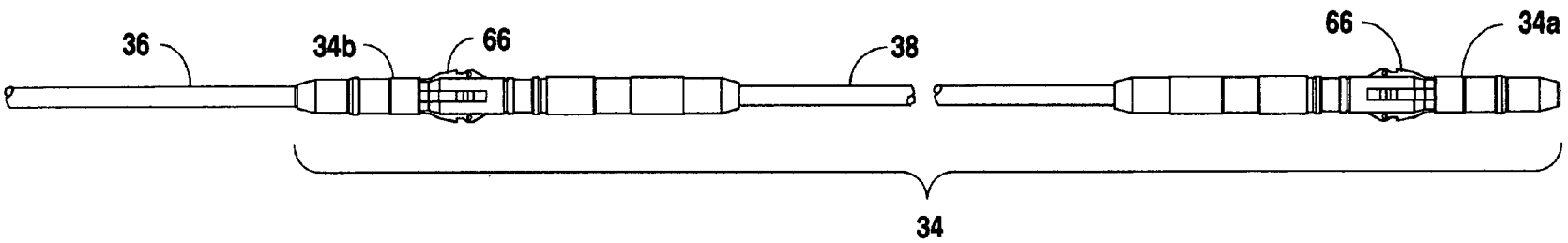
FIG. 2. is a longitudinal view of a shifting tool.

If the shifting tool 34, as shown in FIG. 2, was run into the production well 10 as shown in FIG. 1, the shifting tool 34 and shifting string 36 would go through the internal diameter of casing 16, internal opening of hanger liner 22, through the internal diameter of production tubing 24, as well as through sliding valves 28 and production pipe segments 30. Pressure could be applied to the internal passage 74 of shifting tool 34 through the shifting string 36 to overcome the pressure of springs 72 and to retract the selective keys 66 as the shifting tool 34 is being inserted. However, on the other hand, even without an internal pressure, the shifting tool 34*b*, due to the beveled slope 68, would not engage any of the sliding valves 28*a* thru 28*h* as it is being inserted. On the other hand, the shifting tool 34*a* would engage each of the sliding valves 28 and make sure the inner sleeve 48 is moved to the closed position. After the shifting tool 34*b* extends through sliding valve 28*h*, shifting tool 34*b* can be moved back towards the surface causing the sliding valve 28*h* to open. At that time, the operator of the well can send fracing fluid through the annulus between the production tubing 24 and the shifting string 36. Normally, an acid would be sent down first to dissolve the acid soluble cement 32 around sliding valve 28 (see FIG. 1). After dissolving the cement 32, the operator has the option to frac around sliding valve 28*h*, or the operator may elect to dissolve the cement around other sliding valves 28*a* thru 28*g*. Normally, after dissolving the cement 32 around sliding valve 28*h*, then shifting tool 34*a* would be inserted there through, which closes sliding valve 28*h*. At that point, the system would be pressure checked to insure sliding valve 28*h* was in fact closed. By maintaining the pressure, the selective keys 66 in the shifting tool 34 will remain retracted and the shifting tool 34 can be moved to shifting valve 28*g*. The process is now repeated for shifting valve 28*g*, so that shifting tool 34*b* will open sliding valve 28*g*. Thereafter, the cement 32 is dissolved, sliding valve 28*g* closed, and again the system pressure checked to insure valve 28*g* is closed. This process is repeated until each of the sliding valves 28*a* thru 28*h* has been opened, the cement dissolved, pressure checked after closing, and now the system is ready for fracing.

By determining the depth from the surface, the operator can tell exactly which sliding valve 28*a* thru 28*h* is being opened. By selecting the combination the operator wants to open, then fracing fluid can be pumped through casing 16, production tubing 24, sliding valves 28, and production tubing segments 30 into the formation.

By having a very limited area around the sliding valve 28 that is subject to fracing, the operator now gets fracing deeper into the formation with less fracing fluid. The increase in the depth of the fracing results in an increase in production of oil or gas. The cement 32 between the respective sliding valves 28*a* thru 28*h* confines the fracing fluids to the areas immediately adjacent to the sliding valves 28*a* thru 28*h* that are open.

Any particular combination of the sliding valves 28*a* thru 28*h* can be selected. The operator at the surface can tell when the shifting tool 34 goes through which sliding valves 28*a* thru 28*h* by the depth and increased force as the respective sliding valve is being opened or closed.

Applicant has just described one type of mechanical shifting of mechanical shifting to 34. Other types of shifting tools may be used including electrical, hydraulic, or other mechanical designs. While shifting tool 34 is tried and proven, other designs may be useful depending on how the operator wants to produce the well. For example, the operator may not want to separately dissolve the cement 32 around each sliding valve 28, and pressure check, prior to fracing. The operator may ant to open every third sliding valve 28, dissolve the cement, then frac. Depending upon the operator preference, some other type shifting tool may be easily be used.

Another aspect of the invention is to prevent debris from getting inside sliding valves 28 when the sliding valves 28 are being cemented into place inside of the open hole. To prevent the debris from flowing inside the sliding valve 28, a plug 78 is located in nozzle 46. The plug 78 can be dissolved by the same acid that is used to dissolve the cement 32. For example, if a hydrochloric acid is used, by having a weep hole 80 through an aluminum plug 78, the aluminum plug 78 will quickly be eaten up by the hydrochloric acid. However, to prevent wear at the nozzles 46, the area around the aluminum plus 78 is normally made of titanium. The titanium resists wear from fracing fluids, such as sand.

While the use of plug 78 has been described, plugs 78 may not be necessary. If the sliding valves 28 are closed and the cement 32 does not stick to the inner sleeve 48, plugs 78 may be unnecessary. It all depends on whether the cement 32 will stick to the inner sleeve 48.

Further, the nozzle 46 may be hardened any of a number of ways instead of making the nozzles 46 out of Titanium. The nozzles 46 may be (a) heat treated, (b) frac hardened, (c) made out of tungsten carbide, (d) made out of hardened stainless steel, or (e) made or treated any of a number of different ways to decrease and increase productive life.

Figure 6:
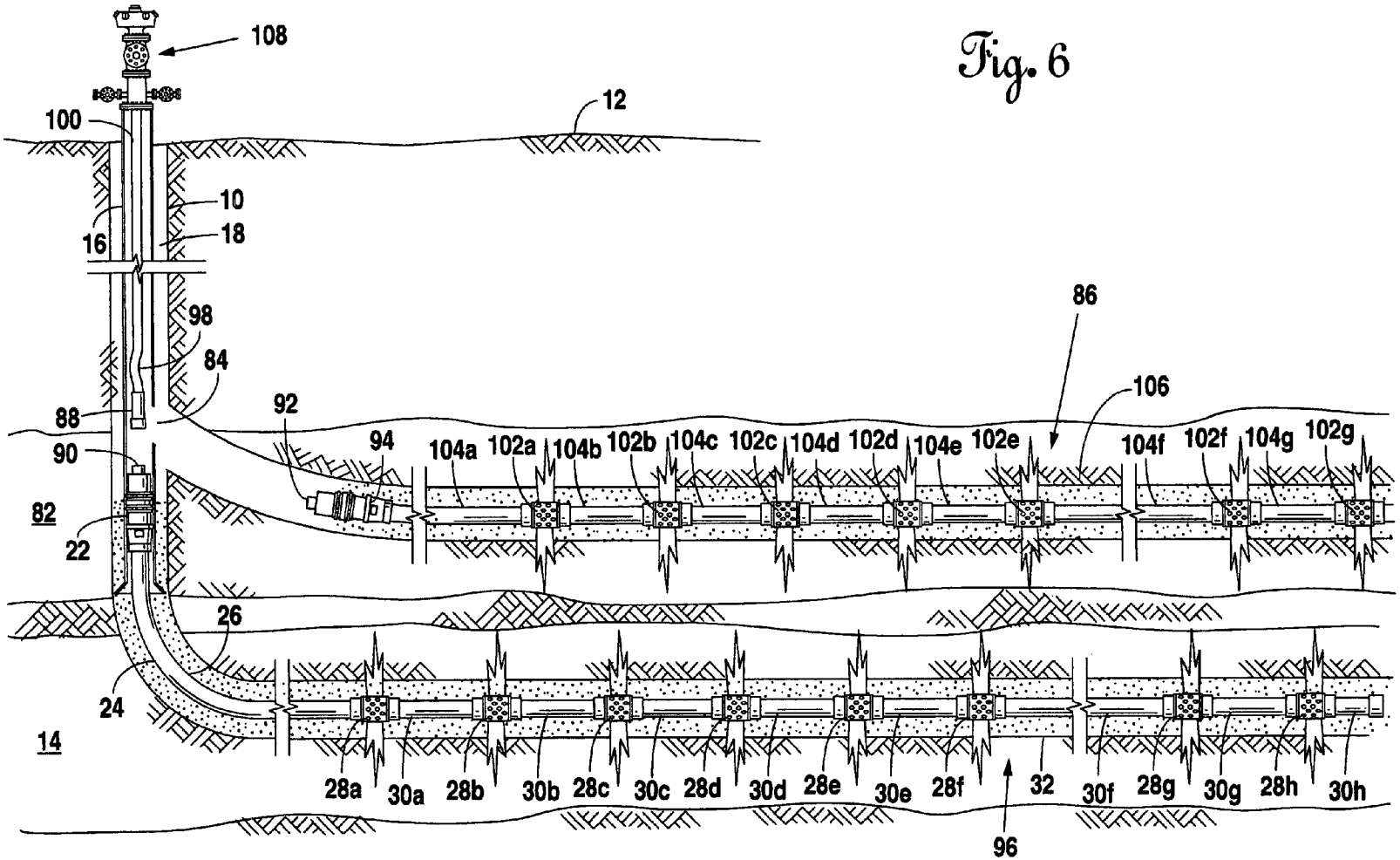
FIG. 6 is a pictorial sectional view of a cemented open hole fracing system having multi laterals.

Assume the system as just described is used in a multilateral formation as shown in FIG. 6. Again, the production well 10 is drilled into the earth 12 and into a hydrocarbon production zone 14, but also into hydrocarbon production zone 82. Again, a liner hanger 22 holds the production tubing 24 that is bent around a radius 26 and connects to sliding valves 28*a* thru 28*h*, via production pipe segments 30*a* thru 30*h*. The production of zone 14, as illustrated in FIG. 6, is the same as the production as illustrated in FIG. 1. However, a window 84 has now been cut in casing 16 and cement 18 so that a horizontal lateral 86 may be drilled there through into hydrocarbon production zone 82.

In the drilling of multi-lateral wells, an on/off tool 88 is used to connect to the stinger 90 on the liner hanger 22 or the stinger 92 on packer 94. Packer 94 can be either a hydraulic set or mechanical set packer to the wall 81 of the horizontal lateral 86. In determining which lateral 86 or 96, the operator is going to connect to, a bend 98 in the vertical production tubing 100 helps guide the on/off tool 88 to the proper lateral 86 or 96. The sliding valves 102*a* thru 102*g* may be identical to the sliding valves 28*a* thru 28*h*. The only difference is sliding valves 102*a* thru 102*g* are located in hydrocarbon production zone 82, which is drilled through the window 84 of the casing 16. Sliding valves 102*a* thru 102*g* and production tubing 104*a* thru 104*g* are cemented into place past the packer 94 in the same manner as previously described in conjunction with FIG. 1. Also, the sliding valves 102*a* thru 102*g* are opened in the same manner as sliding valves 28*a* thru 28*h* as described in conjunction with FIG. 1. Also, the cement 106 may be dissolved in the same manner.

Just as the multi laterals as described in FIG. 6 are shown in hydrocarbon production zones 14 and 82, there may be other laterals drilled in the same zones 14 and/or 82. There is no restriction on the number of laterals that can be drilled nor in the number of zones that can be drilled. Any particular sliding valve may be operated, the cement dissolved, and fracing begun. Any particular sliding valve the operator wants to open can be opened for fracing deep into the formation adjacent the sliding valve.

By use of the system as just described, more pressure can be created in a smaller zone for fracing than is possible with prior systems. Also, the size of the tubulars is not decreased the further down in the well the fluid flows. The decreasing size of tubulars is a particular problem for a series of ball operated valves, each successive ball operated valve being smaller in diameter. This means the same fluid flow can be created in the last sliding valve at the end of the string as would be created in the first sliding valve along the string. Hence, the flow rates can be maintained for any of the selected sliding valves 28*a* thru 28*h* or 102*a* thru 102*g*. This results in the use of less fracing fluid, yet fracing deeper into the formation at a uniform pressure regardless of which sliding valve through which fracing may be occurring. Also, the operator has the option of fracing any combination or number of sliding valves at the same time or shutting off other sliding valves that may be producing undesirables, such as water.

Figure 7:
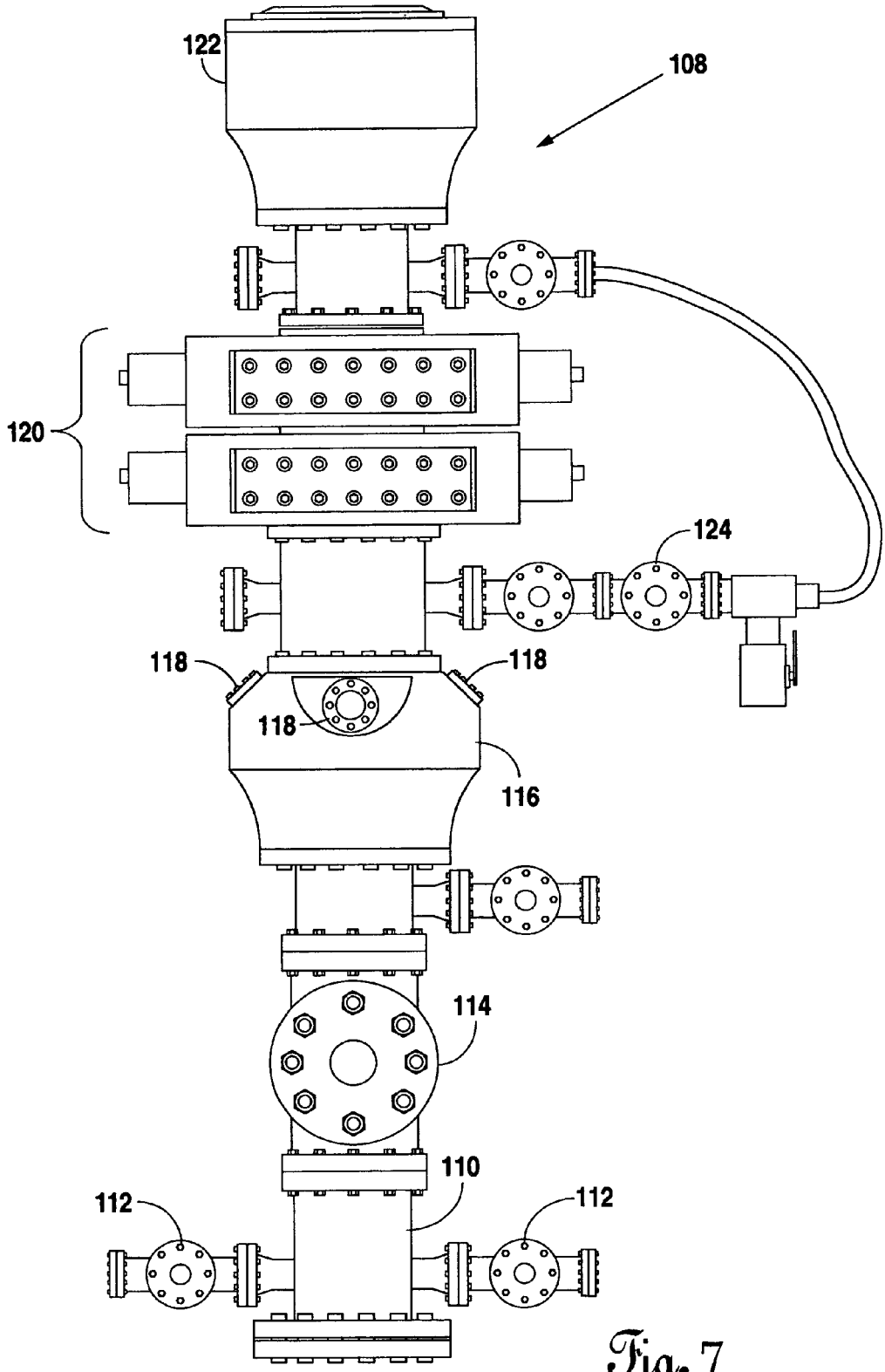
FIG. 7 is an elevated view of a wellhead.

On the top of casing 18 of production well 10 is located a wellhead 108. While many different types of wellheads are available, the wellhead preferred by applicant is illustrated in further detail in FIG. 7. A flange 110 is used to connect to the casing 16 that extends out of the production well 10. On the sides of the flange 110 are standard valves 112 that can be used to check the pressure in the well, or can be used to pump things into the well. A master valve 114 that is basically a float control valve provides a way to shut off the well in case of an emergency. Above the master valve 114 is a goat head 116. This particular goat head 116 has four points of entry 118, whereby fracing fluids, acidizing fluids or other fluids can be pumped into the well. Because sand is many times used as a fracing fluid and is very abrasive, the goat head 116 is modified so sand that is injected at an angle to not excessively wear the goat head. However, by adjusting the flow rate and/or size of the opening, a standard goat head may be used without undue wear.

Above the goat head 116 is located blowout preventer 120, which is standard in the industry. If the well starts to blow, the blowout preventer 120 drives two rams together and squeezes the pipe closed. Above the blowout preventer 120 is located the annular preventer 122. The annular preventer 122 is basically a big balloon squashed around the pipe to keep the pressure in the well bore from escaping to atmosphere. The annular preventer 122 allows access to the well so that pipe or tubing can be moved up and down there through. The equalizing valve 124 allows the pressure to be equalized above and below the blow out preventer 120. The equalizing of pressure is necessary to be able to move the pipe up and down for entry into the wellhead. All parts of the wellhead 108 are old, except the modification of the goat head 116 to provide injection of sand at an angle to prevent excessive wear. Even this modification is not necessary by controlling the flow rate.

Figure 8:
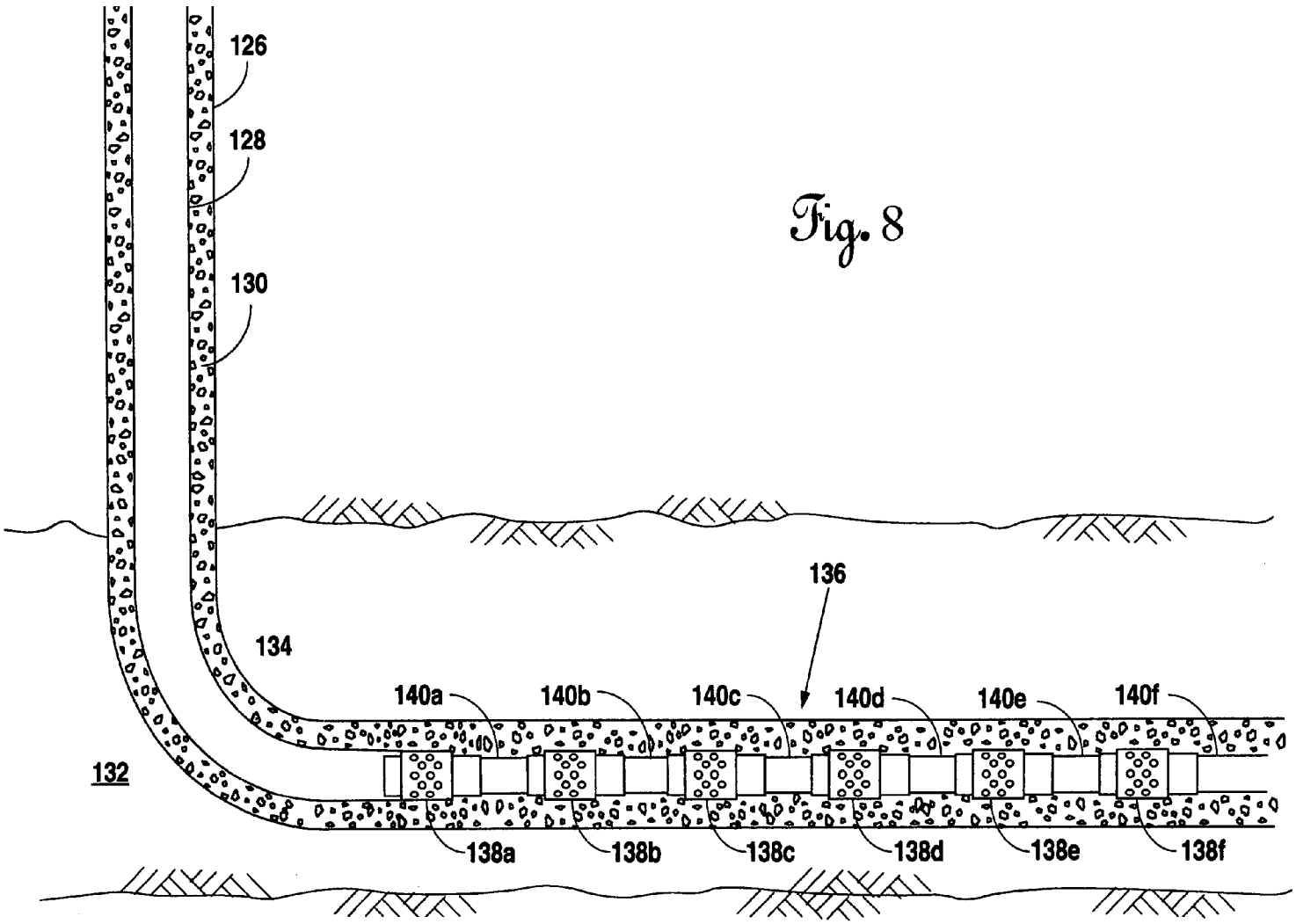
FIG. 8 is a cemented open hole horizontal fracing system.

Turning now to FIG. 8, the system as presently described has been installed in a well 126 without vertical casing. Well 126 has production tubing 128 held into place by cement 130. In the production zone 132, the production tubing 128 bends around radius 134 into a horizontal lateral 136 that follows the production zone 132. The production tubing 128 extends into production zone 132 around the radius 134 and connects to sliding valves 38*a* thru 38*f*, through production tubing segments 140*a* thru 140*f*. Again, the sliding valves 138*a* thru 138*f* may be operated so the cement 130 is dissolved therearound. Thereafter, any of a combination of sliding valves 138*a* thru 138*f* can be operated and the production zone 132 fraced around the opened sliding valve. In this type of system, it is not necessary to cement into place a casing nor is it necessary to use any type of packer or liner hanger. The minimum amount of hardware is permanently connected in well 126, yet fracing throughout the production zone 132 in any particular order as selected by the operator can be accomplished by simply fracing through the selected sliding valves 138*a* thru 138*f*.

Figure 9:
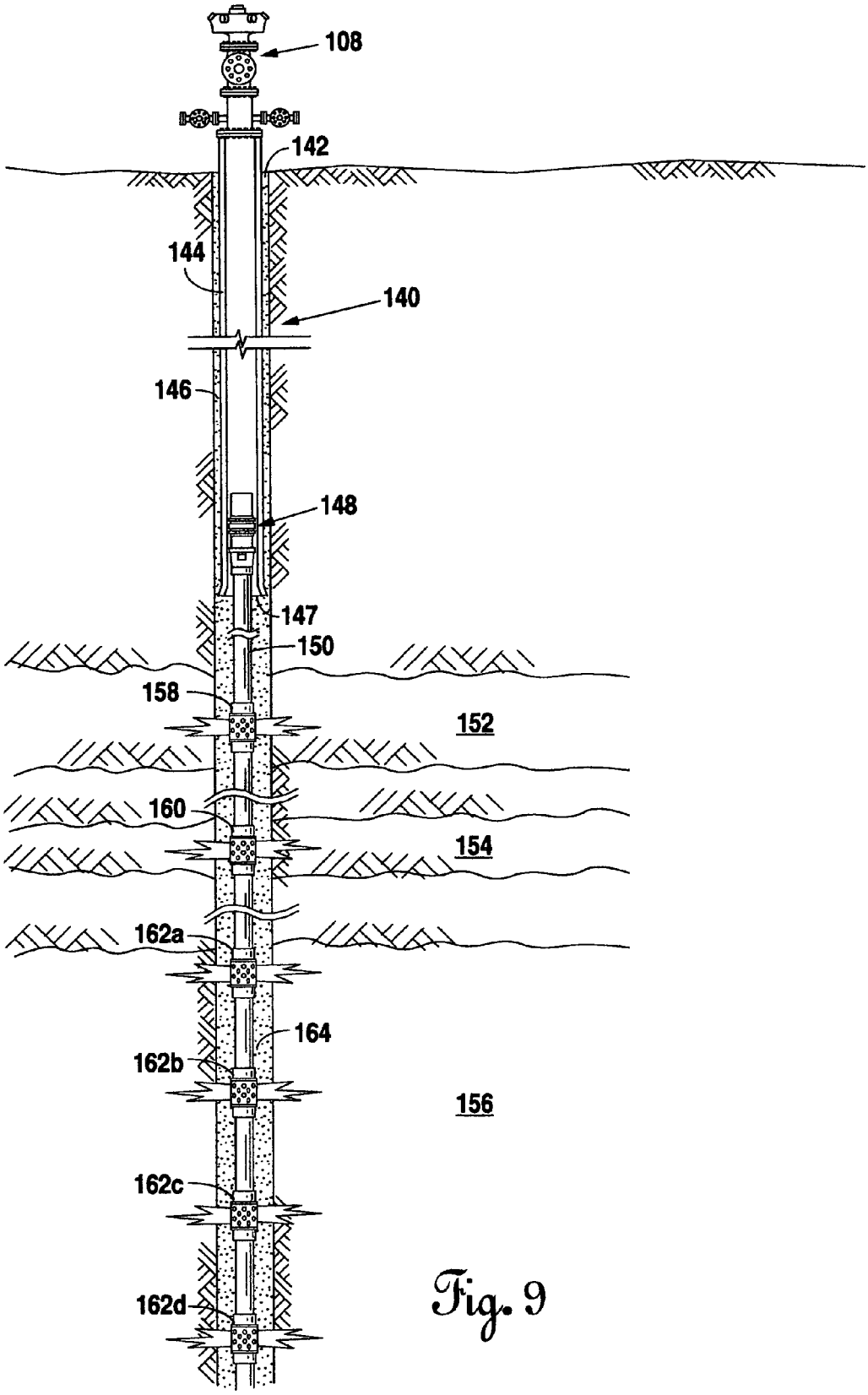
FIG. 9 is a cemented open hole vertical fracing system.

The system previously described can also be used for well 140 that is entirely vertical as shown in FIG. 9. The wellhead 108 connects to casing 144 that is cemented into place by cement 146. At the bottom 147 of casing 144 is located a liner hanger 148. Below liner hanger 148 is production tubing 150. In the well 144, as shown in FIG. 9, there are producing zones 152, 154, and 156. After the production tubing 150 and sliding valves 158, 160, and 162*a* thru 162*d* are cemented into place by acid soluble cement 164, the operator may now produce all or selected zones. For example, by dissolving the cement 164 adjacent sliding valve 158, thereafter, production zone 152 can be fraced and produced through sliding valve 158. Likewise, the operator could dissolve the cement 164 around sliding valve 160 that is located in production zone 154. After dissolving the cement 164 around sliding valve 160, production zone 154 can be fraced and later produced.

On the other hand, if the operator wants to have multiple sliding valves 162*a* thru 162*d* operate in production zone 156, the operator can operate all or any combination of the sliding valves 162*a* thru 162*d*, dissolve the cement 164 therearound, and later frac through all or any combination of the sliding valves 162*a* thru 162*d*. By use of the method as just described, the operator can produce whichever zone 152, 154 or 156 the operator desires with any combination of selected sliding valves 158, 160 or 162.

By use of the method as just described, the operator, by cementing the sliding valves into the open hole and thereafter dissolving the cement, fracing can occur just in the area adjacent to the sliding valve. By having a limited area of fracing, more pressure can be built up into the formation with less fracing fluid, thereby causing deeper fracing into the formation. Such deeper fracing will increase the production from the formation. Also, the fracing fluid is not wasted by distributing fracing fluid over a long area of the well, which results in less pressure forcing the fracing fluid deep into the formation. In fracing over long areas of the well, there is less desirable fracing than what would be the case with the present invention.

The present invention shows a method of fracing in the open hole through cemented in place sliding valves that can be selectively opened or closed depending upon where the production is to occur. Preliminary experiments have shown, the present system described hereinabove produces better fracing and better production at lower cost than prior methods.

The invention claimed is:

1. A method of petroleum production from at least one open hole in at least one petroleum production zone of an oil and/or gas well comprising the following steps:

locating a plurality of sliding valves spaced apart along a production tubing at predetermined locations;

inserting said plurality of said sliding valves and said production tubing into said at lease least one open hole;

cementing said plurality of said sliding valves and said production tubing permanently in place in said at least one open hole with cement, said predetermined locations along said production tubing corresponding to predetermined locations in said at lease least one open hole;

selectively opening said plurality of sliding valves without jetting or cutting tools and selectively dissolving said cement adjacent to said plurality of sliding valves to establish contact with said at least one petroleum production zone;

selectively fracing through said plurality of sliding valves with fracing material; and selectively producing said at least one petroleum production zone through said at lease least one open hole of said oil and/or gas well that has been (a) selectively opened (b) selectively dissolved, and (c) selectively fraced.

2. The method of petroleum production from said at least one open hole in said at least one production zone of said oil and/or gas well as recited in claim 1 including a first step of cementing a casing from a top of said oil and/or gas well downward toward said at least one open hole.

3. The method of petroleum production from said at least one open hole in said at least one production zone of said oil and/or gas well as recited in claim 1 including securing a well head at a top of said casing.

4. The method of petroleum production from said at least one open hole in said at least one production zone of said oil and/or gas well as recited in claim 3 wherein said at least one open hole is a lateral.

5. The method of petroleum production from said at least one open hole in said at least one production zone of said oil and/or gas well as recited in claim 3 wherein said at least one open hole consists of a plurality of lateral open holes, each of said lateral open holes having all of the steps of claim 1 performed thereof.

6. The method of petroleum production from said at least one open hole in said at least one production zone of said oil and/or gas well as recited in claim 5 wherein a first one of said lateral open holes may be selected by an on/off tool connecting to a first stinger on an outer end of said production tubing in said first one of said lateral open holes.

7. The method of petroleum production from said at least one open hole in said at least one production zone of said oil and/or gas well as recited in claim 6 wherein a second one of said lateral open holes may be selected by an on/off tool (a) disconnecting from said first stinger on said outer end of said production tubing in said first one of said lateral open holes and (b) connecting to a second stinger on an outer end of said producing tubing in said second one of said lateral open holes, the steps of claim 1 being repeated.

8. The method of petroleum production from said at least one open hole in said at least one production zone of said oil and/or gas well as recited in claim 7 wherein the steps of claim of 7 and 1 are repeated for each of said lateral open holes.

9. The method of petroleum production from said at least one open hole in said at least one production zone of said oil and/or gas well as recited in claim 3 wherein said all oil and/or gas well has a plurality of petroleum production zones, said steps given in claim 1 being repeated for each plurality of petroleum production zones.

10. The method of petroleum production from said at least one open hole in said at least one production zone of said oil and/or gas well as recited in claim 1 wherein flow rate and/or fracing pressures can be maintained by opening or closing different ones of said sliding valves.

11. The method of petroleum production from said at least one open hole in said at least one production zone of said oil and/or gas well as recited in claim 1 wherein an undesirable production can be reduced by closing different ones of said sliding valves.

* * * * *